US012687337B2

(12) United States Patent
Park et al.

(10) Patent No.: US 12,687,337 B2
(45) Date of Patent: Jul. 21, 2026

(54) REFRIGERATOR

(71) Applicant: SAMSUNG ELECTRONICS CO., LTD., Suwon-si (KR)

(72) Inventors: Sungcheul Park, Suwon-si (KR); Yonghyun Kang, Suwon-si (KR); Hyoseok Noh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 81 days.

(21) Appl. No.: 18/650,974

(22) Filed: Apr. 30, 2024

(65) Prior Publication Data

US 2024/0280314 A1 Aug. 22, 2024

Related U.S. Application Data

(63) Continuation of application No. PCT/KR2022/019034, filed on Nov. 29, 2022.

(30) Foreign Application Priority Data

Jan. 27, 2022 (KR) ..... 10-2022-0012687

(51) Int. Cl.
*F25D 23/06* (2006.01)

(52) U.S. Cl.
CPC ..... *F25D 23/065* (2013.01); *F25D 23/062* (2013.01); *F25D 23/064* (2013.01); *F25D 23/066* (2013.01); *F25D 2201/12* (2013.01)

(58) Field of Classification Search
CPC .. F25D 23/065; F25D 23/062; F25D 2201/12; F25D 2201/10; F25D 23/066; F25D 23/061; F25D 23/064; F25D 23/063; F25D 2201/126; B29C 44/12; B29C 44/1214; B29C 45/14311; B29C 45/372; Y10T 428/24182; Y10T 428/2457; B29L 2031/7622
See application file for complete search history.

(56) References Cited

U.S. PATENT DOCUMENTS 4,740,042 A * 4/1988 Stich ..... F25D 23/04 312/405.1
5,269,601 A * 12/1993 Williams ..... F25D 23/066 312/406.1

(Continued)

FOREIGN PATENT DOCUMENTS

CN 212902196 U 4/2021
EP 2133643 A2 * 12/2009 ..... B29C 48/001

(Continued)

OTHER PUBLICATIONS

KR100390786 translation (Year: 2003).*

(Continued)

*Primary Examiner* — Hiwot E Tefera
(74) *Attorney, Agent, or Firm* — STAAS & HALSEY LLP

(57) ABSTRACT

A refrigerator includes an inner case having a storage compartment therein, an outer case coupled to an outer side of the inner case, and an insulation filled between the inner case and the outer case. The inner case includes an insulation contact surface in contact with the insulation, and the insulation contact surface having a contact area with the insulation larger than other areas of the inner case thereby increasing an adhesion to the insulation.

9 Claims, 9 Drawing Sheets

(56) References Cited

U.S. PATENT DOCUMENTS

| | | | | |
|---|---|---|---|---|
| 6,138,432 | A * | 10/2000 | Banicevic | F25D 23/02 312/405.1 |
| 6,190,755 | B1 | 2/2001 | Addeo et al. | |
| 6,536,227 | B1 | 3/2003 | Lee | |
| 10,345,036 | B2 | 7/2019 | Hong et al. | |
| 10,429,121 | B2 | 10/2019 | Yoon et al. | |
| 2002/0146540 | A1* | 10/2002 | Johnston | E04F 15/02 428/167 |
| 2007/0001563 | A1* | 1/2007 | Park | B29C 44/146 312/406 |
| 2010/0180627 | A1* | 7/2010 | Hanke | F25D 23/06 62/449 |
| 2011/0146054 | A1 | 6/2011 | Selin et al. | |
| 2012/0104923 | A1* | 5/2012 | Jung | F25D 23/065 312/406 |
| 2019/0137166 | A1* | 5/2019 | Dherde | F25D 23/066 |
| 2021/0254885 | A1* | 8/2021 | Jung | B32B 3/30 |
| 2021/0254887 | A1 | 8/2021 | Jung et al. | |
| 2023/0349627 | A1 | 11/2023 | Jung et al. | |

FOREIGN PATENT DOCUMENTS

| | | | | |
|---|---|---|---|---|
| GB | 1216693 | A * | 12/1970 | F25D 23/064 |
| GB | 2143465 | A * | 2/1985 | B29C 49/04 |
| JP | 2004286320 | A * | 10/2004 | |
| JP | 2013-2656 | | 1/2013 | |
| JP | 6857227 | | 4/2021 | |
| KR | 20-0125640 | | 11/1998 | |
| KR | 1999-0035648 | | 9/1999 | |
| KR | 1999-0035649 | | 9/1999 | |
| KR | 2000-0013045 | | 7/2000 | |
| KR | 10-0390786 | | 7/2003 | |
| KR | 10-2004-0090430 | | 10/2004 | |
| KR | 10-0633027 | | 10/2006 | |
| KR | 10-2008-0001251 | | 1/2008 | |
| KR | 10-2012-0044558 | | 5/2012 | |
| KR | 10-1832324 | | 2/2018 | |
| KR | 10-2020-0070195 | | 6/2020 | |
| KR | 10-2209765 | | 1/2021 | |
| KR | 10-2243486 | | 4/2021 | |

OTHER PUBLICATIONS

Supplemental European Search Report dated Jan. 20, 2025 issued in European Application No. EP 22 92 4355.

International Search Report dated Mar. 23, 2023 issued in PCT Application No. PCT/KR2022/019034.

Written Opinion dated Mar. 23, 2023 issued in PCT Application No. PCT/KR2022/019034.

* cited by examiner

REFRIGERATOR

CROSS REFERENCE TO THE RELATED APPLICATION

This application is a continuation application, filed under 35 U.S.C. § 111(a), of International Application PCT/KR2022/019034 filed Nov. 29, 2022, and is based on and claims priority under 35 U.S.C. § 119 to Korean Patent Applications No. 10-2022-0012687, filed on Jan. 27, 2022 in the Korean Intellectual Property Office, the disclosures of which are incorporated by reference herein in their entireties.

TECHNICAL FIELD

The disclosure relates to a refrigerator in which a surface of the injection molded inner case that is in contact with the insulation, is molded to increase adhesion to the insulation.

BACKGROUND ART

In general, a refrigerator, an appliance for keeping food fresh, includes a main body having a storage compartment and a cold air supply device for supplying cold air to the storage compartment. The storage compartment includes a refrigerating compartment in which the food is kept refrigerated at a temperature of approximately 0° C. to 5° C., and a freezing compartment in which the food is kept frozen at a temperature of approximately 0° C. to −30° C.

The main body of a refrigerator is formed by the combination of an inner case and an outer case. The inner case forms a storage compartment, and the outer case forms an exterior of the refrigerator. An insulation is disposed between the inner and outer cases for thermal insulation. The storage compartment of the refrigerator is arranged to have an open front, and the open front is closed by a door to maintain the temperature of the storage compartment.

The urethane used for insulation, is stabilized into a solid by undergoing a chemical reaction from a liquid phase to a solid in a short period of time. Afterwards, over a long period of time during practical use, the residual gas remaining between the urethane cells leaks to the outside, particularly a portion where the adhesion between the inner case and the insulation is poor, forming a large void, and causing the inner case to swell.

Typically, the inner case of a refrigerator is produced by a vacuum molding, which is formed by heating a sheet of resin material, placing the heated sheet on a mold, and drawing in air from the other side of the mold to enable the heated sheet to be enclosed on the mold or to be drawn into the interior of the mold by the suction force.

The inner case formed by the vacuum molding process is manufactured with smooth surfaces on both sides. Accordingly, to increase the adhesion between the inner case and the insulation, a separate process, such as scratching the smooth surface is required after the inner case is molded.

DISCLOSURE

Technical Problem

The present disclosure is directed to a refrigerator in which a surface of an inner case formed by injection molding that is in contact with an insulation is molded to increase adhesion to the insulation during injection molding of the inner case.

Further, the present disclosure is directed to a refrigerator in which a partial surface of surfaces of an inner case that is in contact with an insulation is molded to reduce adhesion to the insulation during injection molding of the inner case.

Technical Solution

According to an embodiment of the present disclosure, a refrigerator includes an inner case having a storage compartment therein, an outer case coupled to an outer side of the inner case, and an insulation filled between the inner case and the outer case, wherein the inner case includes an insulation contact surface in contact with the insulation, and the insulation contact surface having a contact area with the insulation larger than other areas of the inner case thereby increasing an adhesion to the insulation.

The inner case may include a plurality of plates which are connected to one another to form the inner case, and each of the plurality of plates has the insulation contact surface.

The insulation contact surface may be corroded to have a rough surface so that the insulation is filled in the rough surface to increase the contact area with the insulation thereby increasing the adhesion to the insulation.

A pattern of engraving may be formed on the insulation contact surface so that the insulation is filled in the engraved pattern to increase the contact area with the insulation thereby increasing the adhesion to the insulation.

A pattern of embossing may be formed on the insulation contact surface so that the insulation is filled in the embossed pattern to increase the contact area with the insulation thereby increasing the adhesion to the insulation.

The insulation contact surface may be prevented from being exposed to outside, and the inner case may include an exposed surface formed on a surface opposite to the insulation contact surface and exposed to the outside.

A pattern may be formed on the exposed surface so that the insulation is filled in the pattern to increase the contact area with the insulation thereby increasing the adhesion to the insulation.

According an embodiment of the present disclosure, a refrigerator comprising an inner case having a storage compartment therein, an outer case coupled to an outer side of the inner case, and an insulation filled between the inner case and the outer case. The inner case may include an insulation contact surface in contact with the insulation, and the insulation contact surface may include a mirror surface formed in a portion of the insulation contact surface so that the contact area with the insulation is reduced thereby decreasing the adhesion to the insulation.

The mirror surface may have a smooth surface so that the insulation is filled in the smooth surface to decrease the contact area with the insulation.

The mirror surface may reduce a transmission to the inner case of an impact generated in response to a portion of the insulation being broken due to a temperature difference between the inside and outside of the storage compartment.

Advantageous Effects

According to various embodiments of the present disclosure, the refrigerator may prevent swelling of the inner case that may occur under practical conditions of use of the refrigerator by molding the surface of the inner case to increase the adhesion of the surface of the inner case and the insulation during injection molding of the inner case.

Further, according to various embodiments of the present disclosure, by molding the surfaces of the inner case to reduce the adhesion of the insulation to some of the surfaces of the inner case in contact with the insulation during injection molding, the refrigerator may prevent the impact generated by the breaking of a portion of the insulation under practical conditions of use from being transmitted to the inner case, thereby preventing the inner case from breaking together.

MODES OF THE INVENTION

Figure 1:
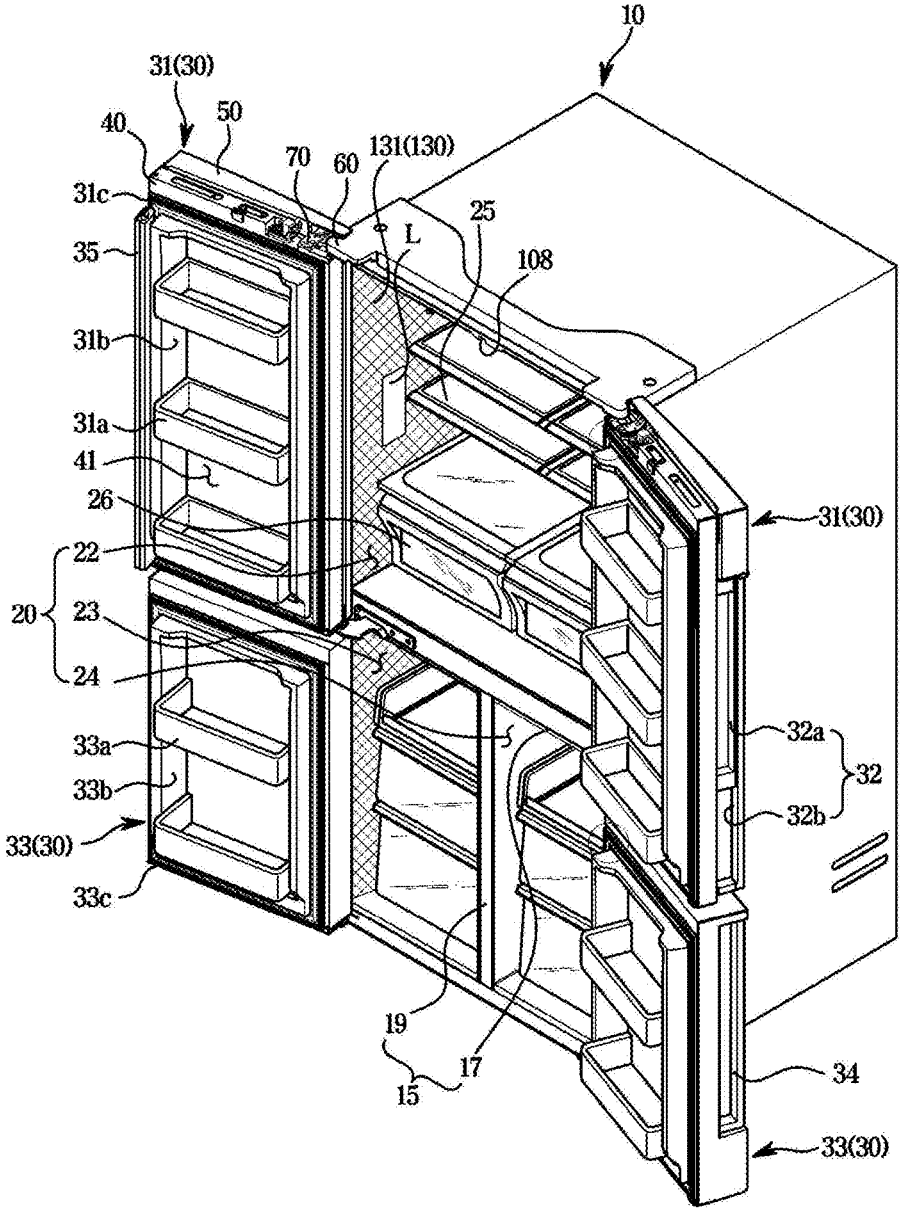
FIG. 1 is a view illustrating the front of a refrigerator according to an embodiment, with a first door and a second door open together.

Various embodiments of the present document and terms used therein are not intended to limit the technical features described in this document to specific embodiments, and should be understood to include various modifications, equivalents, or substitutes of the corresponding embodiments.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", "left", "right", and the like are defined with reference to the drawings and are not intended to limit the shape and location of each component.

Hereinafter, various embodiments according to the disclosure will be described in detail with reference to the accompanying drawings.

Figure 2:
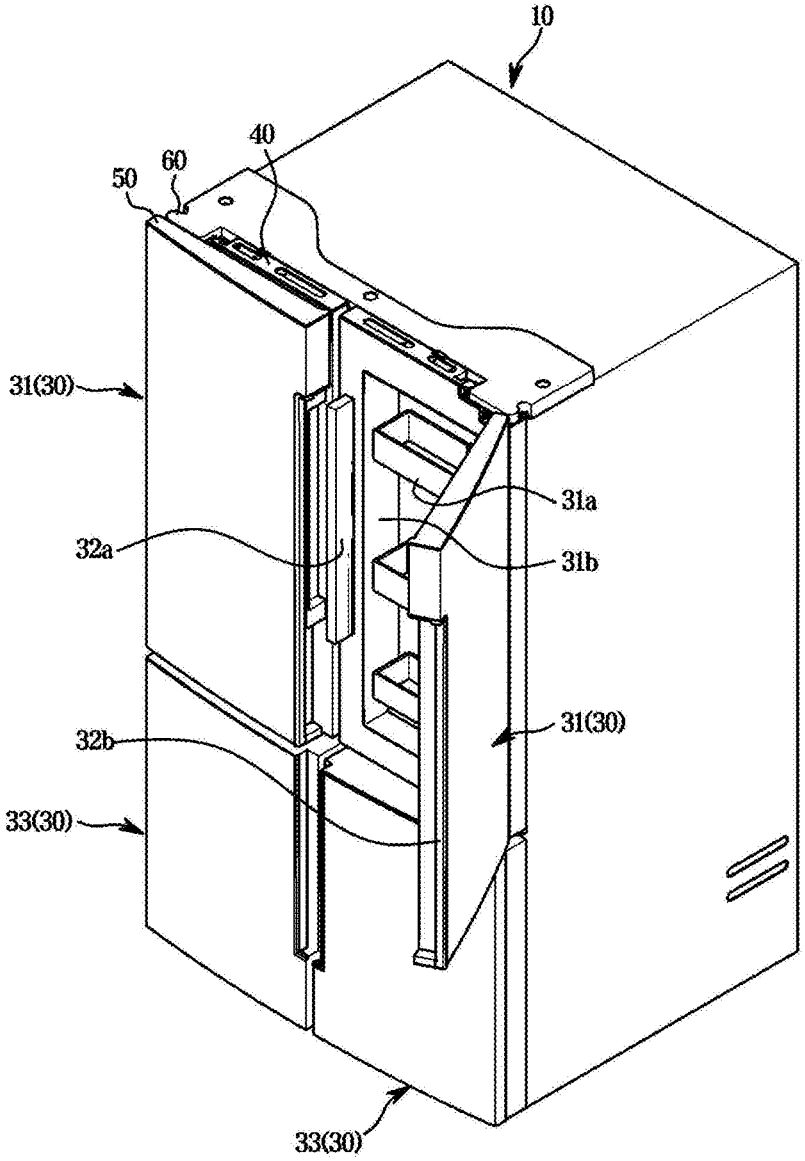
FIG. 2 is a view illustrating one of the second doors of the refrigerator of FIG. 1 in an open state.
Figure 3:
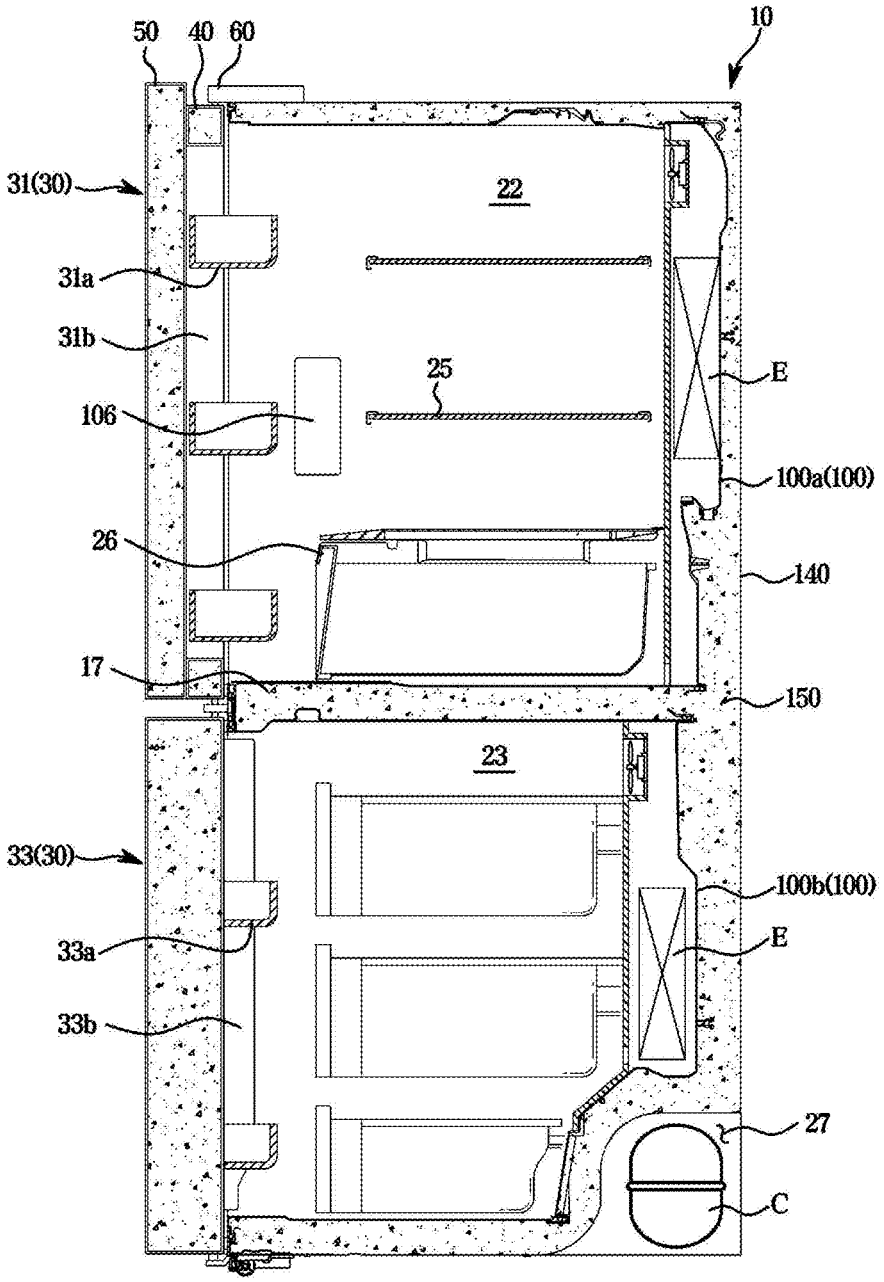
FIG. 3 is a schematic side cross-sectional view of the refrigerator according to an embodiment.

FIG. 1 is a view illustrating a front side of a refrigerator according to an embodiment, with a first door and a second door open together. FIG. 2 is a view illustrating one of the second doors of the refrigerator of FIG. 1 in an open state. FIG. 3 is a schematic side cross-sectional view of the refrigerator according to an embodiment.

As shown in FIGS. 1 to 3, the refrigerator may include a main body 10, a storage compartment 20 formed by dividing the main body 10 into upper and lower rooms within the main body 10, a door 30 that opens or closes the storage compartment 20, and a cold air supply device (not shown) that supplies cold air to the storage compartment 20.

The main body 10 may include an inner case 100 forming the storage compartment 20, an outer case 140 coupled to an outer side of the inner case 100 to form the exterior thereof, and an insulation 150 foamed between the inner case 100 and the outer case 140 to thermally insulate the storage compartment 20.

The inner case 100 may include an insulation contact surface 110 that is in contact with the insulation 150, and an exposed surface 130 that is an opposite side to the insulation contact surface 110. The insulation contact surface 110 may be a surface in contact with the insulation 150, which may be prevented from being exposed to the outside. The exposed surface 130 may be a surface on the opposite side of the insulation contact surface 110 that is not in contact with the insulation 150, which may be exposed to the outside. Various patterns 131 may be formed on the exposed surface 130 exposed to the outside during injection molding of the inner case 100. Because various patterns 131 may be formed on the exposed surface 130 during injection molding of the inner case 100, separate post-processing after molding the inner case 100 may not be required. By forming various patterns 131 on the exposed surface 130 exposed to the outside, a user may have a wider range of choices when selecting a refrigerator (see FIG. 6).

A machine compartment 27 may be provided at a rear lower side of the main body 10 in which a compressor C that compresses a refrigerant and a condenser (not shown) that condenses the refrigerant compressed by the compressor C are installed.

The cold air supply device may include the compressor C for compressing the refrigerant, the condenser (not shown) for condensing the refrigerant, an expansion valve (not shown) for expanding the refrigerant, and an evaporator E for evaporating the refrigerant.

The storage compartment 20 may be divided into a plurality of partitions 15, and a plurality of shelves 25 and storage containers 26 may be provided within the storage compartment 20 to store food or the like.

The storage compartment 20 may be partitioned into a plurality of storage compartments 22, 23, and 24 by the partitions 15, wherein the partitions 15 may include a first partition 17 horizontally coupled to the interior of the storage compartment 20 to divide the storage compartment 20 into the upper storage compartment 22 and the lower storage compartments 23 and 24, and a second partition 19 vertically coupled to the lower storage compartments 23 and 24 to divide the lower storage compartments 23 and 24 into the first storage compartment 23 and the second storage compartment 23.

The partition 15, which has a T-shape due to the combination of the first partition 17 and the second partition 19, may divide the storage compartment 20 into three spaces. Of the upper storage compartment 22 and the lower storage compartments 23 and 24 divided by the first partition 17, the upper storage compartment 22 may be used as a refrigerating compartment, and the lower storage compartments 23 and 24 may be used as a freezing compartment.

The lower storage compartments 23 and 24 may be used entirely as a freezing compartment, but the first storage compartment 23 may be used as a freezing compartment and the second storage compartment 24 may be used as a refrigerating compartment. Alternatively, the first storage compartment 23 may be used as a freezing compartment and the second storage compartment 24 may be used as both a freezing compartment and a refrigerating compartment.

The division of the storage compartment 20 as described above is by way of an example, and each of the storage compartments 22, 23, and 24 may be used differently from the configuration described above.

The refrigerating compartment 22 and the freezing compartments 23 and 24 may each be opened and closed by the door 30 rotatably coupled to the main body 10.

The door 30 may include a pair of refrigerating compartment doors 31 rotatably coupled to the main body 10 to open or close the refrigerating compartment 22, and a pair of refrigerating compartment doors 33 rotatably coupled to the main body 10 to open or close the freezing compartments 23 and 24.

The pair of refrigerating compartment doors 31 may be opened or closed by a pair of refrigerating compartment door handles 32, each including a first door handle 32*a* or a second door handle 32*b*. The refrigerating compartment 22 may be opened or closed by the pair of refrigerating compartment doors 31, and a rotating bar 35 may be provided on at least one of the pair of refrigerating compartment doors 31 such that when the pair of refrigerating compartment doors 31 are closed, the refrigerating compartment doors 31 may be sealed without creating a gap therebetween. The rotating bar 35 may be rotatably coupled to the at least one of the pair of refrigerating compartment doors 31. The rotating bar 35 may be guided to rotate in response to opening or closing of the refrigerating compartment doors 31 by a rotation guide 108 formed on the inner case 100.

The pair of freezing compartment doors 33 may be opened or closed respectively by the freezer door handle 34. The doors that open or close the freezing compartments 23 and 24 may be sliding doors.

Door shelves 31*a* and 33*a* for placing food may be provided on a rear surface of each of the pair of refrigerating compartment doors 31 and the pair of freezing compartment doors 33.

Each of the door shelves 31*a* and 33*a* may include shelf supports 31*b* and 33*b* extending vertically from the respective doors 31 and 33 to support the respective door shelves 31*a* and 33*a* on both left and right sides of the respective door shelves 31*a* and 33*a*. The shelf supports 31*b* and 33*b* may be detachably provided on the respective doors 31 and 33 in separate configurations.

In addition, first gaskets 31*c* and 33*c* may be provided on a border of a rear surface of the respective doors 31 and 33 to seal a gap between the door and the main body 10 when the respective doors 31 and 33 are closed. The first gaskets 31*c* and 33*c* may be installed in the form of a loop along the border of the rear surface of the respective doors 31 and 33, and may include a magnet (not shown) therein.

The pair of refrigerating compartment doors 31 that open or close the refrigerating compartment 22 may be disposed on the left and right. In the following, for ease of description, only the refrigerating compartment door 31 disposed on the left side of the drawings will be described, and the refrigerating compartment door 31 disposed on the left side of the drawings will be referred to as the refrigerating compartment door 31. However, the refrigerating compartment door 31 described herein is not limited to the refrigerating compartment door 31 disposed on the left side of the drawings, but may also be applied to the refrigerating compartment door 31 disposed on the right side of the drawings, and may also be applied to at least one of the pair of freezing compartment doors 33.

The refrigerating compartment door 31 may be provided as a double door including a first door 40 and a second door 50.

The first door 40 may be rotatably connected to the main body 10 by a first hinge 60 and may open or close the refrigerating compartment 22. The door shelf 31*a*, the shelf support 31*b*, and the first gasket 31*c* described above may be provided in the first door 40.

The first door 40 may include an opening 41 formed to allow a user to access the door shelf 31*a* to store or remove food in a state where the first door 40 is closed. Such opening 41 may be formed through the first door 40 and may be opened and closed by the second door 50.

The second door 50 may be disposed on a front side of the first door 40 to open or close the opening 41 of the first door 40, and may be rotatably arranged in the same direction as the first door 40. Although the drawing shows the second door 50 as being rotatably supported on a second hinge 70 installed on the first door 40 to be rotatable relative to the first door 40, but the second door 50 is not limited thereto. The second door 50 may be rotatably disposed relative to the main body 10 due to the second hinge 70 installed on the main body 10.

The second door 50 may include a second gasket (not shown) to maintain a seal with the first door 40. The second gasket may be installed in a loop shape along a border of a rear surface of the second door 50, and may include a magnet (not shown) therein.

Figure 4:
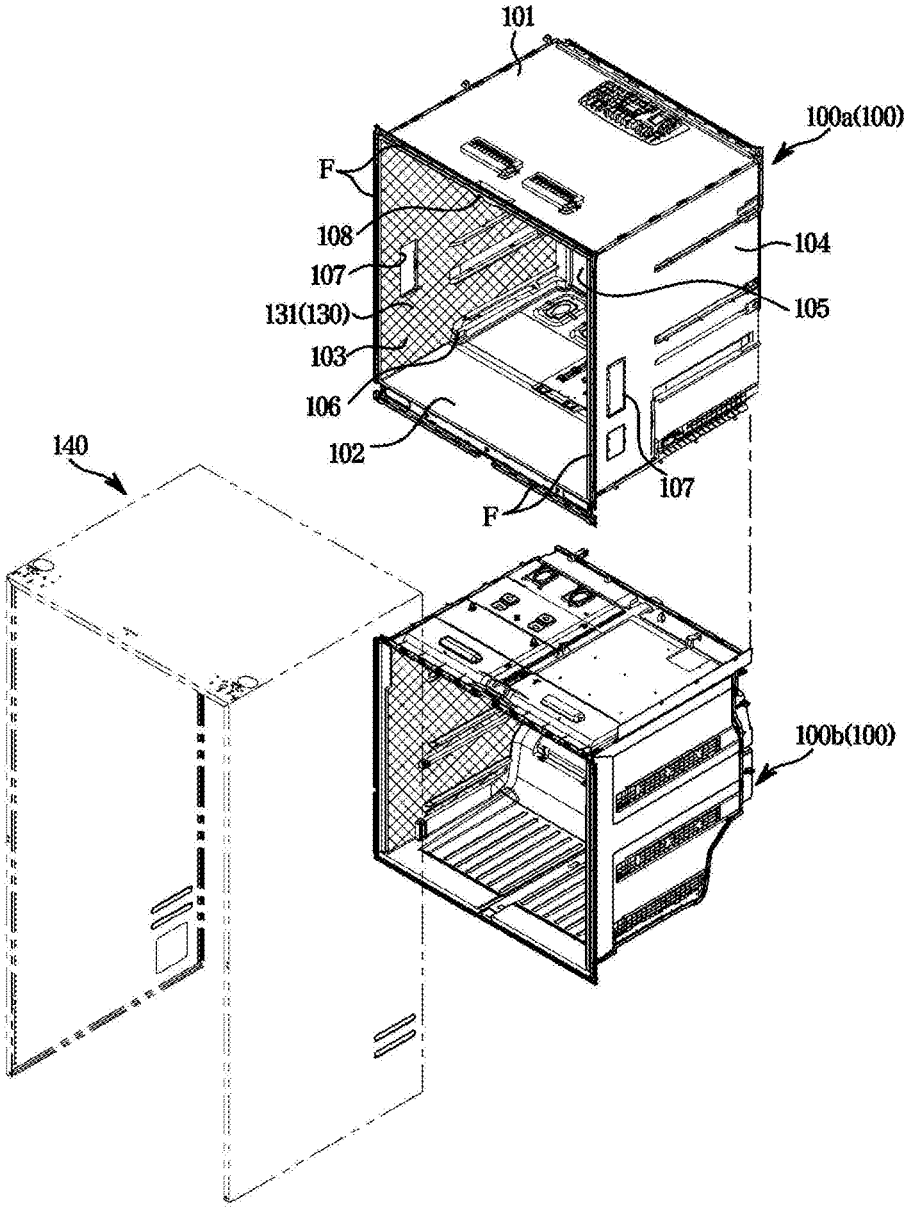
FIG. 4 is a view illustrating a separation of the inner and outer cases according to an embodiment.
Figure 5:
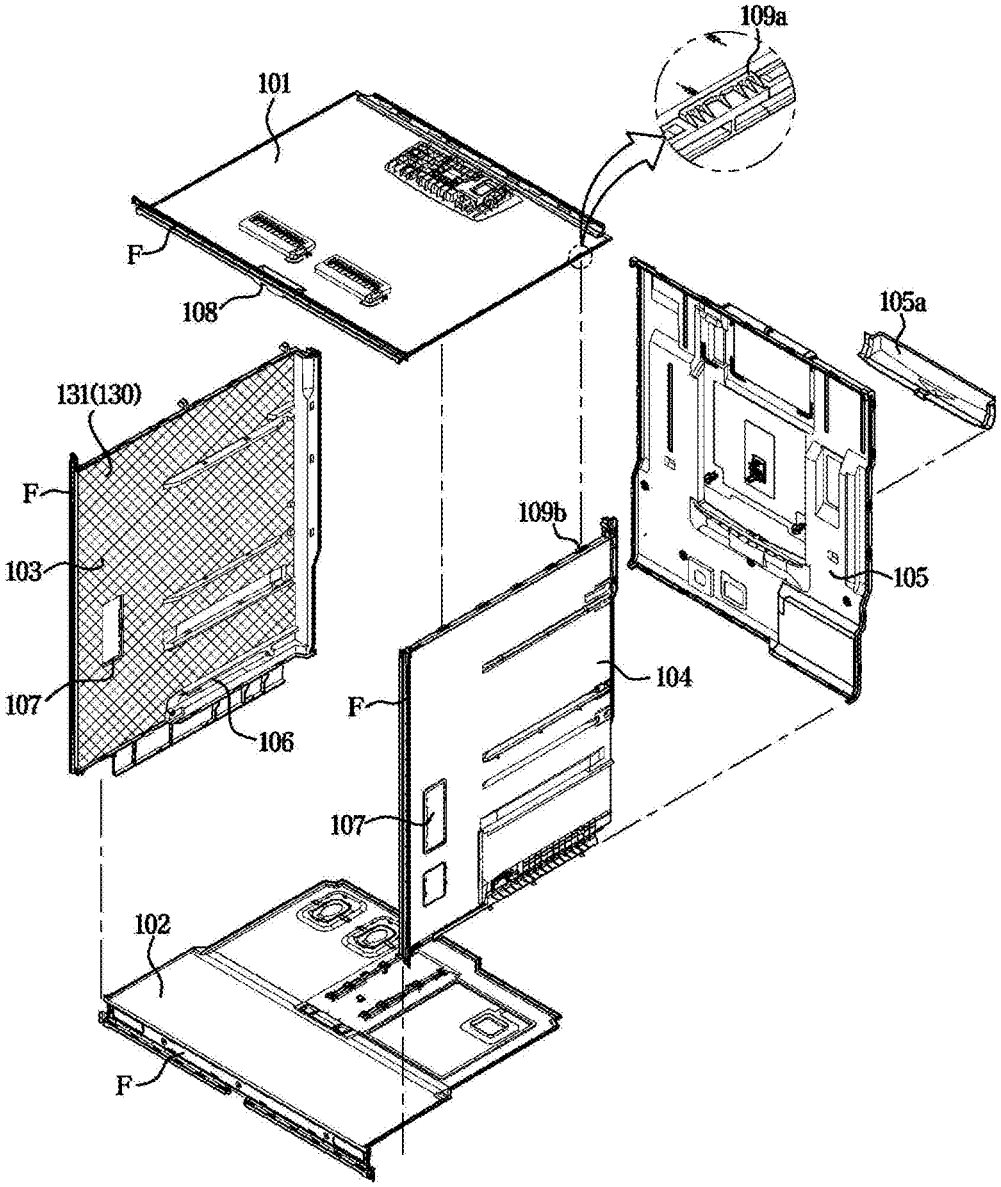
FIG. 5 is a view illustrating a disassembled first inner case according to an embodiment.

FIG. 4 is a view illustrating a separation of the inner and outer cases according to an embodiment. FIG. 5 is a view illustrating a disassembled first inner case according to an embodiment.

As shown in FIGS. 4 and 5, the inner case 100 may include a first inner case 100*a* forming the refrigerating compartment 22 located at an upper portion of the freezing compartments, and a second inner case 100*b* forming the freezing compartments 23 and 24 located at a lower portion of the refrigerating compartment 22. Since the first inner case 100*a* and the second inner case 100*b* may differ only slightly in shape but may be coupled by the same coupling structure, the first inner case 100*a* may be referred to as the inner case 100 and will be described below.

The inner case 100 may include an upper plate 101, a lower plate 102, a left plate 103, a right plate 104, and a back plate 105. The upper plate 101, the lower plate 102, the left plate 103, the right plate 104, and the back plate 105 may be configured as divided. The upper plate 101, the lower plate 102, the left plate 103, the right plate 104, and the back plate 105 may all be injection molded. The upper plate 101, the lower plate 102, the left plate 103, the right plate 104, and the back plate 105, which are configured in segments, may be assembled to form the inner case 100. The upper plate 101, the lower plate 102, the left plate 103, the right plate 104, and the back plate 105 may all include the insulation contact surface 110 that is in contact with the insulation material 150, and the exposed surface 130 that is the opposite side of the insulation contact surface 110. The exposed surface 130, which is exposed to the outside, may have various patterns 131 formed thereon during injection molding of the inner case 100. Although the drawings show the pattern 131 being formed only on the exposed surface 130 of the left plate 103, but is not limited thereto. In other words, the pattern 131 may be formed on all of the exposed surfaces 130 of the upper plate 101, the lower plate 102, the left plate 103, the right plate 104, and the back plate 105. Alternatively, the pattern 131 may be formed only on some of the exposed surfaces 130 of the upper plate 101, the lower plate 102, the left plate 103, the right plate 104, and the back plate 105. The pattern 131 formed on the exposed surface 130 may have a different pattern 131 depending on the purpose of the storage compartment 20. In addition, the exposed surfaces 130 of the upper plate 101, the lower plate 102, the left plate 103, the right plate 104, and the back plate 105 may all have different patterns. Since various patterns 131 may be formed on the exposed surface 130 during injection molding of the inner case 100, separate post-processing may not be required after molding the inner case 100 (see FIG. 6).

In addition, although not shown in the drawings, the upper plate 101, the lower plate 102, the left plate 103, the right plate 104, and the back plate 105 may be molded to have different colors. In other words, the storage compartment 20 may have different colors depending on its purpose. In addition, the upper plate 101, the lower plate 102, the left plate 103, the right plate 104, and the back plate 105 may all have different colors. This may allow the user to have more choice when selecting a refrigerator.

The shape of the upper plate 101, the lower plate 102, the left plate 103, the right plate 104, and the back plate 105 may be not limited to a flat shape without curves, and the upper plate 101, the lower plate 102, the left plate 103, the right plate 104, and the back plate 105 may include curves. It may be sufficient for the upper plate 101, the lower plate 102, the left plate 103, the right plate 104, and the back plate 105 are shaped to form an upper, lower, left, right, and rear surfaces of the refrigerating compartment 22, respectively.

In addition, although the drawings show the upper plate 101, the lower plate 102, the left plate 103, the right plate 104, and the back plate 105 as each being divided, but the present disclosure is not limited thereto. In other words, at least two adjacent plates of the upper plate 101, the lower plate 102, the left plate 103, the right plate 104, and the back plate 105 may be formed integrally.

For example, the upper plate 101 and the right plate 104 may be injection molded integrally. In addition, the lower plate 102 and the left plate 103 may be injection molded integrally. In addition, the upper plate 101 and the left plate 103 may be injection molded integrally. In addition, the lower plate 102 and the right plate 104 may be injection molded integrally.

As described above, although the inner case 100 may include a smaller number of plates, such as five plates of the upper plate 101, the lower plate 102, the left plate 103, the right plate 104, and the back plate 105, the contents described below may be still applied.

The upper plate 101, the lower plate 102, the left plate 103, and the right plate 104 may each have a front flange F integrally formed thereon. Since the upper plate 101, the lower plate 102, the left plate 103, and the right plate 104 are all injection molded, the front flange F covering the front of the inner case 100 may be integrally formed on the upper plate 101 and the lower plate 102, the left plate 103, and the right plate 104.

On a lower surface of the upper plate 101, the rotation guide 108 may be integrally injection molded to guide the rotating bar 35, which is rotatably coupled to the pair of refrigerating compartment doors 31, to rotate in response to rotation of the refrigerating compartment door 31 (see FIG. 1).

Rails 106 that support the storage container 26 for sliding may be integrally injection molded on the left plate 103 and the right plate 104. A case lamp 107 on which an LED (L) is mounted may be integrally injection molded on the left plate 103 and the right plate 104 (see FIG. 1).

The back plate 105 may be injection molded in a thin film to make the material cost competitive, which may require a number of gates (not shown). The back plate 105 may include a drainage member 105*a* for draining condensed water falling from the evaporator E. The drainage member 105*a* may be detachably coupled to the back plate 105. This may be because the gate may not be positioned in the drainage member 105*a* due to the shape of the drainage member 105*a*, so that the drainage member 105*a* may not be injection molded integrally with the back plate 105.

A plurality of assembly hooks 109*a* or a plurality of assembly holes 109*b* may be formed on the upper plate 101, the lower plate 102, the left plate 103, the right plate 104, and the back plate 105 for assembly. Since the upper plate 101, the lower plate 102, the left plate 103, and the right plate 104 are assembled together through the remaining three edge surfaces of the four edge surfaces except for the front, the plurality of assembly hooks 109*a* or the plurality of assembly holes 109*b* may be formed on the remaining three edge surfaces except for the front flange F. The back plate 105 may have the plurality of assembly hooks 109*a* or the plurality of assembly holes 109*b* formed on all four edge surfaces. In other words, describing the assembly of the upper plate 101 and the right plate 104 as an example, the plurality of assembly hooks 109*a* may be formed on the right side of the upper plate 101, and the plurality of assembly holes 109*b* may be formed on the upper surface of the right plate 104 that is assembled on the right surface of the upper plate 101. Although the drawings show that the plurality of assembly hooks 109*a* is formed on the right surface of the upper plate 101 and the plurality of assembly holes 109*b* is formed on the upper surface of the right plate 104, the plurality of assembly holes 109*b* may be formed on the right surface of the upper plate 101 and the plurality of assembly hooks 109*a* may be formed on the upper surface of the right plate 104. For the lower plate 102, since the plurality of assembly hooks 109*a* is formed on a lower side of the three edge surfaces, the plurality of assembly hooks 109*a* may not be shown in the drawings.

Figure 6:
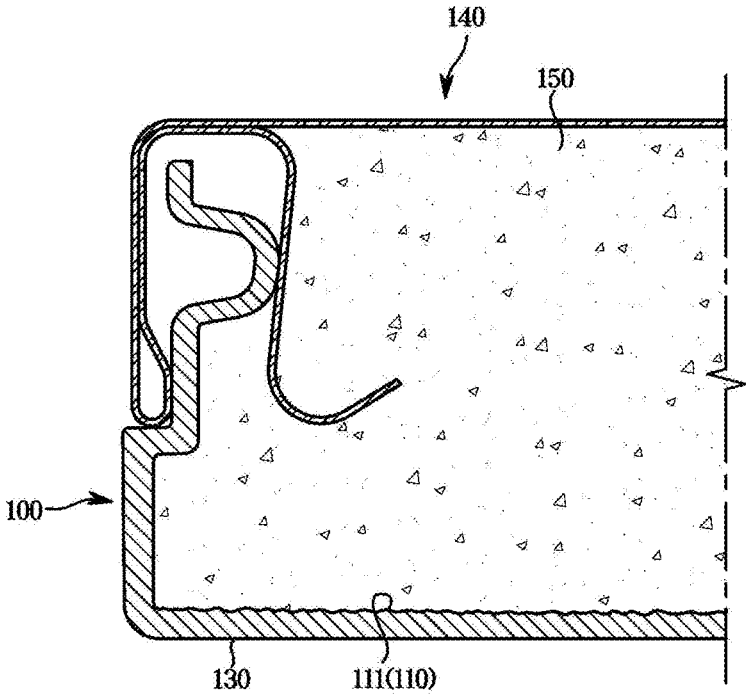
FIG. 6 is a cross-sectional view schematically illustrating an insulation contact surface of the inner case being corroded to have a rough surface, according to an embodiment.
Figure 7:
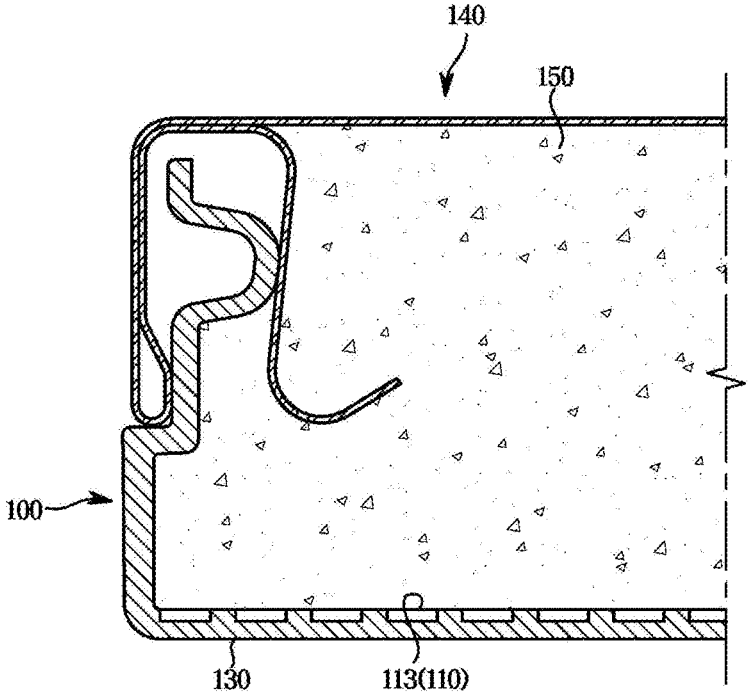
FIG. 7 is a cross-sectional view schematically illustrating a pattern of engraving formed on the insulation contact surface of the inner case according to an embodiment.
Figure 8:
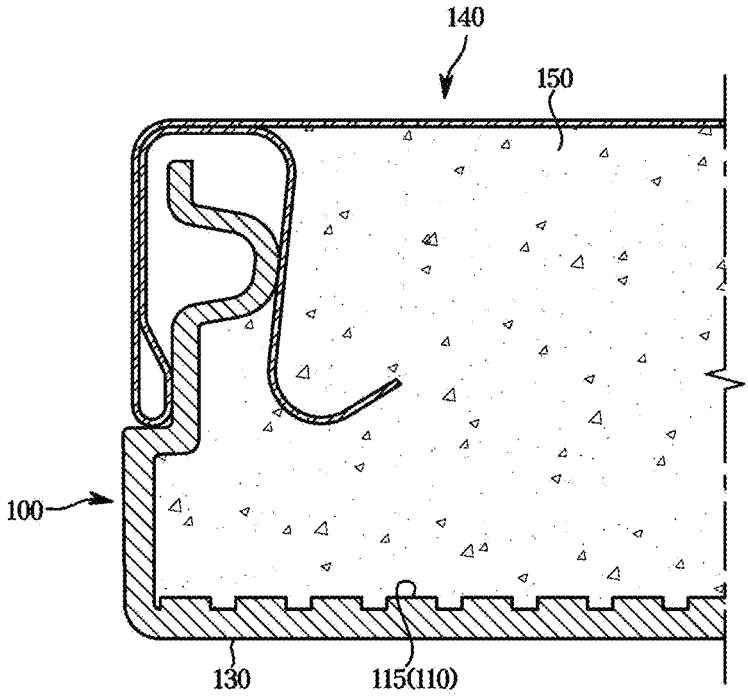
FIG. 8 is a cross-sectional view schematically illustrating a pattern of embossing formed on the contact surface of the insulation of the inner case according to an embodiment.
Figure 9:
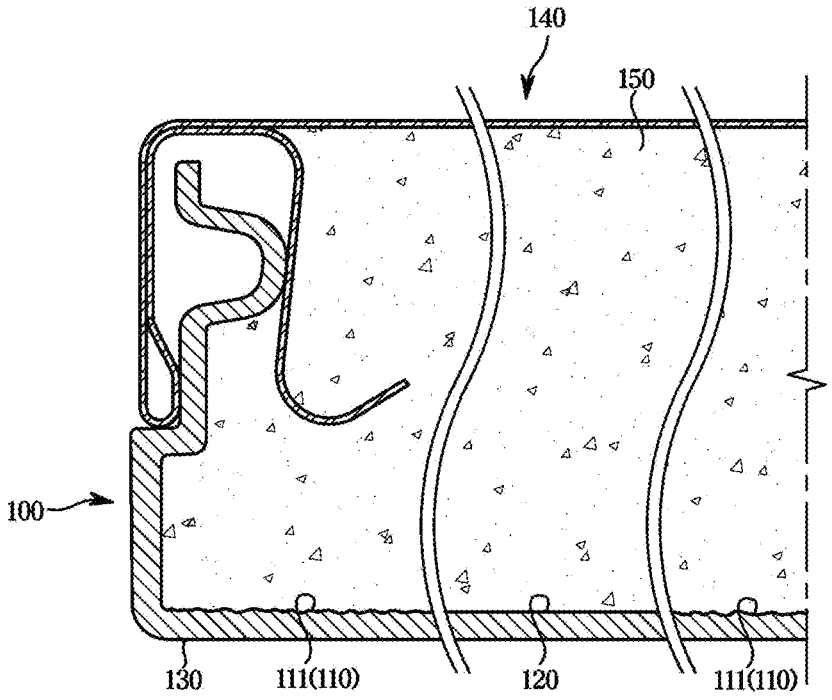
FIG. 9 is a cross-sectional view schematically illustrating a mirror surface formed on a portion of the insulation contact surface of the inner case according to an embodiment.

FIG. 6 is a cross-sectional view schematically showing the insulation contact surface of the insulation of the inner case being corroded to have a rough surface according to an embodiment. FIG. 7 is a cross-sectional view schematically showing a pattern of engraving formed on the insulation contact surface of the inner case according to an embodiment. FIG. 8 is a cross-sectional view schematically showing a pattern of embossing formed on the insulation contact surface of the inner case according to an embodiment. FIG. 9 is a cross-sectional view schematically showing a mirror surface formed on a portion of the insulation contact surface of the inner case according to an embodiment.

As shown in FIG. 6, the inner case 100 may include the insulation contact surface 110 that is in contact with the insulation 150. The insulation contact surface 110 may be the surface where the insulation 150 filled between the inner case 100 and the outer case 140 contacts, and may require a strong adhesion with the insulation 150. The urethane used as the insulation 150 may be stabilized as a solid by undergoing a chemical reaction from a liquid phase to a solid in a short period of time. After the urethane is stabilized as a solid, the residual gas remaining between the urethane cells may leak out over a long period of time during practical use, particularly in a portion where the adhesion between the inner case 100 and the insulation 150 is poor, forming a large void, and causing the inner case 100 to swell. Accordingly, to prevent the inner case 100 from swelling due to a void being formed between the inner case 100 and the insulation 150, the insulation contact surface 110 may be molded to have a strong adhesive to bond with the insulation 150.

The insulation contact surface 110 may be molded to have the increased contact area with the insulation 150 for strong adhesion with the insulation 150. The insulation contact surface 110 may be corroded to have a rough surface during injection molding of the inner case 100 so that the contact area with the insulation 150 is increased. In other words, the insulation contact surface 110 may be a corroded insulation contact surface 111 that has been corroded to have a rough surface. Since the corroded insulation contact surface 111 has a rough surface compared to a smooth surface, the contact area with the insulation 150 may be increased. As such, the corroded insulation contact surface 111 may have increased adhesion to the insulation 150.

The exposed surface 130, which is the opposite side of the corroded insulation contact surface 111, may be the surface of the inner case 100 exposed to the outside, and various patterns 131 may be formed on the exposed surface 130 during injection molding of the inner case 100. Although not shown in the drawings, to form various patterns 131 on the exposed surface 130 during injection molding of the inner case 100, a photoresist may be applied to the surface of a mold (not shown) for molding the inner case 100 and a patterned film embodied in black and white may be add and irradiated with light, so that only the white (transparent) portion of the film may react to the light, thereby allowing a pattern to be imprinted on the mold. The pattern imprinted on the mold may be molded onto the exposed surface 130 during injection molding of the inner case 100 (see FIG. 1).

As shown in FIG. 7, the insulation contact surface 110 may be molded such that a pattern of engraving is formed during injection molding of the inner case 100 to increase the contact area with the insulation 150. In other words, the insulation contact surface 110 may be an insulation contact surface 113 having the pattern of engraving formed thereon. The insulation contact surface 113 having the pattern of engraving may have the increased contact area with the insulation 150 compared to a smooth surface. Accordingly, the insulation contact surface 113 on which the pattern of engraving is formed may have increased adhesion with the insulation 150.

The exposed surface 130, which is the surface opposite to the insulation contact surface 113 having the engraved pattern formed thereon, may be the same as the exposed surface 130 shown in FIG. 6.

As shown in FIG. 8, the insulation contact surface 110 may be molded such that a pattern of embossing is formed during injection molding of the inner case 100 to increase the contact area with the insulation 150. In other words, the insulation contact surface 110 may be an insulation contact surface 115 having the pattern of embossing formed thereon. The insulation contact surface 115 having the pattern of embossing may have the increased contact area with the insulation 150 compared to a smooth surface. Accordingly, the insulation contact surface 115 on which the pattern of embossing is formed may have increased adhesion with the insulation 150.

The exposed surface 130, which is the opposite surface to the insulation contact surface 115 having the embossed pattern formed thereon, may be the same as the exposed surface 130 shown in FIG. 6.

As shown in FIGS. 7 and 8, the insulation contact surface 110 may be molded such that to form a pattern of an irregular shape (e.g., a concavo-convex pattern) during injection molding of the inner case 100 to increase the contact area with the insulation 150. In other words, the insulation contact surface 110 may be the insulation contact surface 113 with the engraved pattern, or the insulation contact surface 115 with the embossed pattern.

As shown in FIG. 9, the insulation contact surface 110 may include a mirror surface 120. The mirror surface 120 may be molded into some regions of the insulation contact surface 110. The mirror surface 120 may be molded in some regions of the insulation contact surface 110 to reduce the contact area with the insulation 150 during injection molding of the inner case 100.

Some regions of the insulation contact surface 110 that are bonded to the insulation 150 may require weak adhesion to the insulation 150. Under operating conditions of the refrigerator, the inside of the insulation 150 may contract and the outside may expand due to the influence of temperatures inside and outside the storage compartment 20 (see FIG. 1). As a result, cracks may occur in some regions of the insulation contact surface 110 where stresses are concentrated, and the impact may be transmitted to the insulation contact surface 110 in contact with the insulation 150, thereby causing cracks in the inner case 100. To prevent such a situation, some regions of the insulation contact surface 110 may be molded into the mirror surface 120 having the smooth surface to reduce adhesion to the insulation 150. The mirror surface 120 formed on some regions of the insulation contact surface 110 may reduce the contact resistance with the inner case 100, thereby preventing cracks generated in the insulation 150 from being transmitted to the inner case 100. The portion of the insulation contact surface 110 where the mirror surface 120 is molded may be some regions, for example, around the case lamp 107 (see FIG. 1).

Although not shown in the drawings, the mirror surface 120 may be formed on the insulation contact surface 110 during injection molding of the inner case 100 by mirror machining certain regions of the mold for forming the inner case 100.

While the present disclosure has been particularly described with reference to exemplary embodiments, it should be understood by those of skilled in the art that various changes in form and details may be made without departing from the spirit and scope of the present disclosure.

What is claimed is:

1. A refrigerator comprising: an inner case having a storage compartment therein; an outer case coupled to an outer side of the inner case; and an insulation filled between the inner case and the outer case; wherein the inner case includes an insulation contact surface in contact with the insulation, and the insulation contact surface is formed by a mold having a textured pattern so that, during injection molding of the inner case, the texture is transferred to the surface to increase a contact area with the insulation and to improve adhesion uniformity between the insulation contact surface and the insulation, wherein the insulation contact surface and the inner case are integrally molded to each other during the injection molding to form a bond such that voids between them are reduced, thereby enhancing adhesion uniformity without separate post-processing, wherein the inner case includes an exposed surface formed on a surface opposite to the insulation contact surface and exposed to the outside; wherein a pattern is formed on the exposed surface so that the insulation is filled in the pattern on the exposed surface to increase the contact area with the insulation; wherein the pattern on the exposed surface is formed by applying a photoresist to the mold during the injection molding of the inner case.

2. The refrigerator of claim 1, wherein the inner case includes a plurality of plates which are connected to one another to form the inner case, and each of the plurality of plates has the insulation contact surface.

3. The refrigerator of claim 1, wherein the insulation contact surface is configured to be corroded to have a rough surface so that the insulation is filled in the rough surface to increase the contact area with the insulation thereby increasing the adhesion to the insulation.

4. The refrigerator of claim 1, wherein a pattern of engraving is formed on the insulation contact surface so that the insulation is filled in the engraved pattern to increase the contact area with the insulation thereby increasing the adhesion to the insulation.

5. The refrigerator of claim 1, wherein a pattern of embossing is formed on the insulation contact surface so that the insulation is filled in the embossed pattern to increase the contact area with the insulation thereby increasing the adhesion to the insulation.

6. The refrigerator of claim 1, wherein the insulation contact surface is prevented from being exposed to the outside.

7. A refrigerator comprising: an inner case having a storage compartment therein; an outer case coupled to an outer side of the inner case; and an insulation filled between the inner case and the outer case; wherein the inner case includes an insulation contact surface in contact with the insulation, and the insulation contact surface includes a mirror surface that is a smooth surface and a plurality of corroded surfaces that have been corroded to have a rough surface plurality of the corroded surfaces configured to locally increase a contact area with the insulation so as to increase adhesion, wherein the insulation contact surface and the inner case are integrally molded to each other during injection molding of the inner case to form a bond such that voids between them are reduced, thereby improving adhesion uniformity between the inner case and the insulation without separate post-processing.

8. The refrigerator of claim 7, wherein the insulation is filled in the smooth surface to decrease the contact area with the insulation thereby reducing adhesion to the insulation.

9. The refrigerator of claim 8, wherein the mirror surface is configured to reduce a transmission to the inner case of an impact generated in response to a portion of the insulation being broken due to a temperature difference between an inside and outside of the storage compartment.

* * * * *